US006710253B2

(12) United States Patent
Wildschut

(10) Patent No.: US 6,710,253 B2
(45) Date of Patent: Mar. 23, 2004

(54) ELECTRIC FENCE TAPE, ROPE OR WIRE AND FILAMENT THEREFOR

(75) Inventor: Dirk Wildschut, Wijckel (NL)

(73) Assignee: Lankhorst Indutech B.V., Sneek (NL)

( * ) Notice: Subject to any disclaimer, the term of this patent is extended or adjusted under 35 U.S.C. 154(b) by 0 days.

(21) Appl. No.: 09/975,537

(22) Filed: Oct. 11, 2001

(65) Prior Publication Data

US 2002/0066895 A1 Jun. 6, 2002

(30) Foreign Application Priority Data

Jul. 27, 2000 (NL) ..... 1015829

(51) Int. Cl.[7] ..... H01B 5/00

(52) U.S. Cl. ..... 174/126.1; 174/126.2; 174/117 M

(58) Field of Search ..... 174/126.2, 117 M, 174/117 F, 128.1, 126.1, 125.1

(56) References Cited

U.S. PATENT DOCUMENTS

| | | | | |
|---|---|---|---|---|
| 3,264,404 A | * | 8/1966 | Trebby et al. | 174/130 |
| 3,900,701 A | * | 8/1975 | Bayles et al. | 174/102 R |
| 3,980,277 A | * | 9/1976 | Enoksson | 256/10 |
| 4,342,814 A | * | 8/1982 | Usuki et al. | 428/383 |
| 4,860,996 A | | 8/1989 | Robbins, III | |
| 4,905,969 A | | 3/1990 | Kurschner et al. | |
| 5,036,166 A | * | 7/1991 | Monopoli | 174/128.1 |
| 5,468,557 A | | 11/1995 | Nishio et al. | |
| 2002/0058143 A1 | * | 5/2002 | Hunt et al. | 428/412 |

FOREIGN PATENT DOCUMENTS

| | | |
|---|---|---|
| DE | 197 03 390 | 5/1998 |
| EP | 0 256 841 | 11/1995 |
| FR | 2 625 599 | 7/1989 |
| FR | 2 681 505 | 3/1993 |
| GB | 2 321 762 | 8/1998 |
| WO | WO 98/20505 | 5/1998 |

OTHER PUBLICATIONS

Dr. Muller Verfahrenstechnik GmbH, product data sheet, "Composite Material Technology and Manufacture", Apr. 05, 2000, 1 Page.

Editor: M.R. Creemers, et al., Publisher: Koninklijke PBNA BV, "Poly–Technisch Zakboekje", 1989, bibliographic information page, "Table 1.5 Metalen" Page E1/7 (plus copy with partial translation), and "Table 1.6 Legeringen" Page E1/8 (plus copy with partial tranlation).

* cited by examiner

*Primary Examiner*—Chau N. Nguyen
(74) *Attorney, Agent, or Firm*—Pearne & Gordon LLP

(57) ABSTRACT

A fence tape, rope or wire for transmitting an electric current to an animal that touches the fence tape, rope or wire, having a support structure and an electrically conductive conduction structure (3). The conduction structure (3) has different electrically conductive materials having mutually distinctive electrical and mechanical properties. One of the materials has a better electrical conductivity. The other material has a greater resistance to tensile and bending loads. The conduction structure (3) contains at least one composite filament having, viewed in cross section, a conduction zone (4) from the electrically better conducting material and a self-supporting support zone (5) from the better material as to tensile and bending loadability. Mechanical loading of the electrically better conductive material is limited and an electrically conductive bridge is even maintained if an interruption of the electrically better conductive material occurs. A filament (3) for use in the proposed tape, wire or rope is also described.

11 Claims, 2 Drawing Sheets

ELECTRIC FENCE TAPE, ROPE OR WIRE AND FILAMENT THEREFOR

FIELD OF THE INVENTION

The invention relates to fence tape, rope or wire according to the introductory part of claim 1, and to a filament according to the introductory part of claim 6.

BACKGROUND OF THE INVENTION AND DESCRIPTION OF RELATED ART

Such fence tape, rope or wire—which is understood to include strip and ribbon-shaped as well as knitted and braided designs—is provided with electrical conductors and, after being installed along an area for keeping animals, is connected to a voltage source. An animal that touches the tape, rope or wire is exposed to the electric voltage generated by that voltage source and as a result gets an electric shock, so that the animal is startled and is discouraged from touching the fence. The risk that animals leave an area bounded by the fence or damage the fence is thus limited, without the fence needing to be made of robust design.

Important properties of such fence tape, rope or wire are a good conduction of electricity, so that with a voltage source a great length of the fence can be put under sufficient voltage, and a good resistance to corrosion in combination with repeated mechanical loads, so that the fence can remain installed for a long time without the electrical conductivity falling below a particular minimum value. Of particular importance in this regard is that a sudden failure of the electrical conductivity, as a result of which parts of the fence are no longer served with voltage, be prevented.

A fence tape, rope or wire and filaments of the initially indicated type are known from European patent specification 0 256 841, which discloses electric tape and wire in which, in addition to a textile support structure, two groups of conductive filaments are incorporated which have different mechanical and electrical properties, the first group of conductors having better mechanical properties and the other group of conductors having a better electrical conductivity.

In use, local rupture of the filaments occurs sooner in the filaments from material having a better electrical conductivity than in the filaments from material having better mechanical properties. The latter then constitute bridges across the interruptions of the filaments from the material having the better electrical conductivity. As a result, upon local rupture of the filaments from material having the better electrical conductivity, conductivity losses of the tape, wire or rope as a whole are limited. Nonetheless, in the course of time, there is a considerable deterioration of the total conductivity of the tape, wire or rope and especially under corrosive atmospheric conditions, electrolytic corrosion is still found to have an adverse influence on the practical useful life of the tape, wire or rope.

French patent application 2 625 599 also proposes an electric rope or ribbon which is manufactured from a textile fabric or a braided or twined wire, in which two kinds of conductors are incorporated, of which the first kind has a good conduction and the second kind possesses a high strength. In that application, in addition, as prior art, the use of galvanized iron wire is mentioned. With the latter solution, it is true, a reasonable resistance to mechanical loads and corrosion is achieved, but the electrical conductivity is clearly inferior to that in the solutions discussed hereinabove.

In international patent application WO 98/20505, an electric wire or rope is described which is composed of a core from a non-conductive, strong material, such as a plastic fiber, and a braided outer jacket. The jacket comprises both conductive and non-conductive fibers. The fibers are incorporated in the configuration of a helix in the knitted fabric of the jacket for improving the resistance of the construction against fatigue and damage. The conductive fibers may be manufactured from copper, a copper alloy, another metal provided with a coating from copper, or copper with a coating from another metal. In this electric wire, all conductors are manufactured from a material having a very good electrical conductivity but having less good mechanical properties than other electrically conductive materials suitable for use in such fence material. As a result, at points where the material is subject to high mechanical loads, as adjacent points of attachment to posts and the like, a complete interruption of the conductivity can easily arise in that all conductors rupture.

The same problem also applies to electric tape or rope known from French patent application 2 681 505. According to this publication, in a textile woven or rope, conductors from a copper/zinc alloy with cadmium are incorporated, the conductors being provided with a nickel coating for preventing corrosion. It is proposed to apply a layer of nickel of 1–3 $\mu$m to increase the resistance to corrosion.

In German patent application 197 03 390, a fence rope is described with a conductor consisting of a steel core with a copper jacket.

It is an object of the invention, in respect of fence tape, wire or rope with filaments from different materials, to further limit losses of electrical conductivity as a result of rupture of electrical conductors, without the electrical conductivity in undamaged condition being essentially reduced.

This object is achieved, according to the present invention, by designing a fence tape, wire or rope in accordance with claim 1.

The invention further provides a filament according to claim 6, which is especially arranged for incorporation in fence tape, wire or rope according to claim 1.

Due to the support zone and the conduction zone forming part of the same filament, the conduction zone is highly effectively supported by the support zone, in particular in that the conduction zone forms a core of the at least one filament and the support zone constitutes a jacket enveloping the core.

As a result, undue deformation of the conduction zone is prevented. Rupture of the conduction zone under the influence of mechanical loading of a filament is thereby prevented.

The self-supporting support zone from the material that is better resistant to mechanical loads limits the mechanical loads operatively exerted on the electrically better conductive material. Due to the support zone being self-supporting, it can, even in the event of interruption of the conduction zone as a result of, for instance, chafing, undue deformation or fatigue, operatively maintain the continuity of the conductive filament in the area where the conduction zone is interrupted. Because the conduction zone in practice, also after prolonged use, is interrupted only locally, and the conduction zone and the support zone are part of the same filament, the distance over which the support zone electrically bridges any interruptions in the conduction zone is very short. As a result, the electrical conductivity of the filament, in the event of interruption of the conduction zone, is impaired only over a very short distance and, in the event of local interruption of the conduction zone, the total electrical conductivity over a given greater length of the filament deteriorates only very little.

BRIEF DESCRIPTION OF THE DRAWINGS

Advantageous embodiments of the invention are set forth in the subclaims. In the following, the invention is further illustrated and elucidated on the basis of an exemplary embodiment, with reference to the drawing. In the drawing:

DETAILED DESCRIPTION OF THE INVENTION

The invention will first be described with reference to FIGS. 1 and 3. The exemplary embodiment represented in FIG. 3 constitutes the exemplary embodiment of a fence tape, rope or wire according to the invention that is presently preferred most. The choice as regards the textile design aspects depends mainly on considerations of use (such as the kind of animals that is to be kept behind the fence), which are not essentially different from those for types of fence tape, rope or wire already known FIG. 2 shows an alternative exemplary embodiment, in which an electric wire or rope 7 is composed of three strands of nine filaments 8, 9 each. In this example, too, the non-conductive filaments 8 are represented in contour and the conductive filaments 9 are represented in solid black. The electric wire or rope 7 preferably contains such an excess in length of electrically conductive filaments, that the electrically conductive filaments form flat loops projecting from the non-conductive filaments 8.

Figure 1:
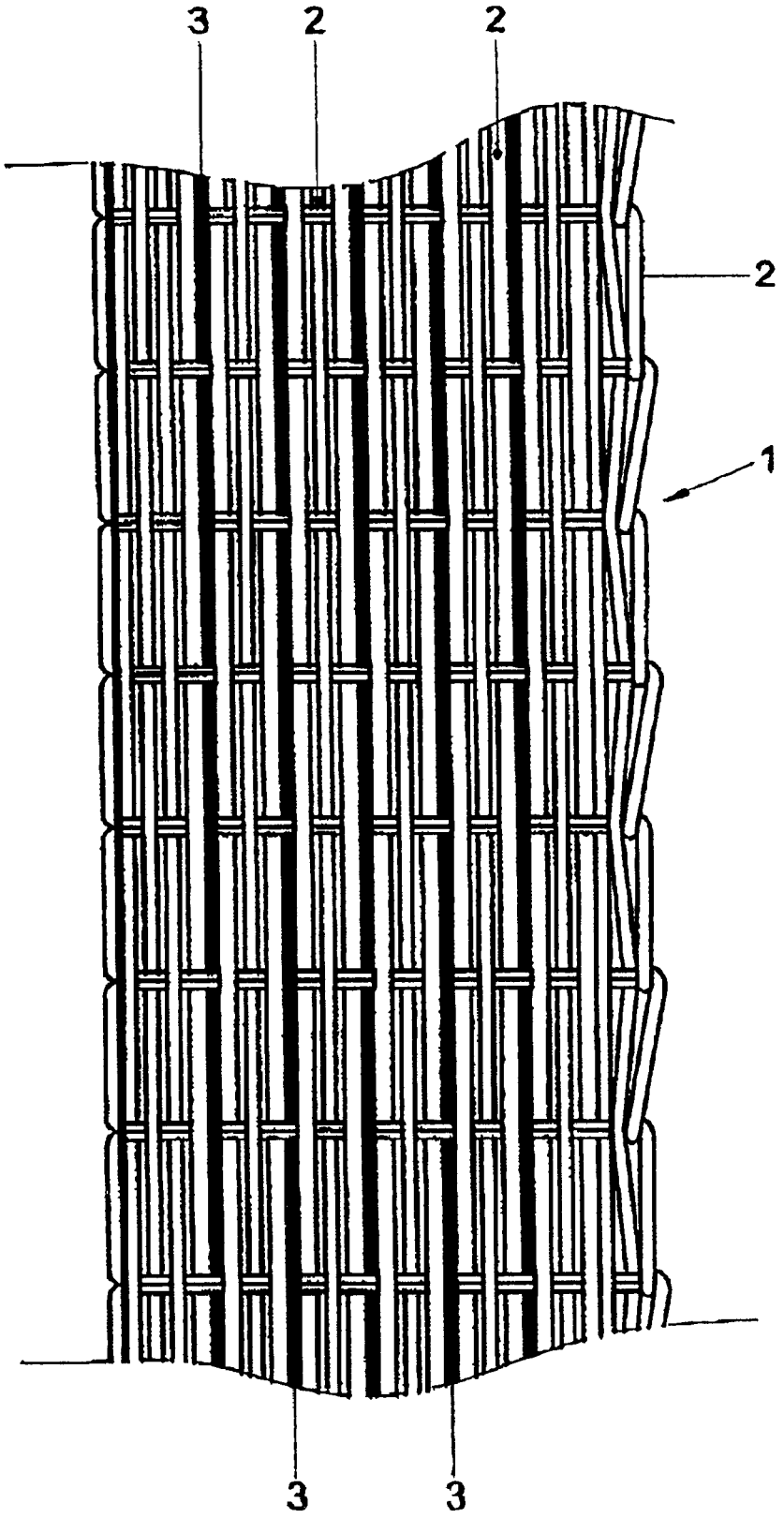
FIG. 1 shows a top plan view of a fence tape.
Figure 2:
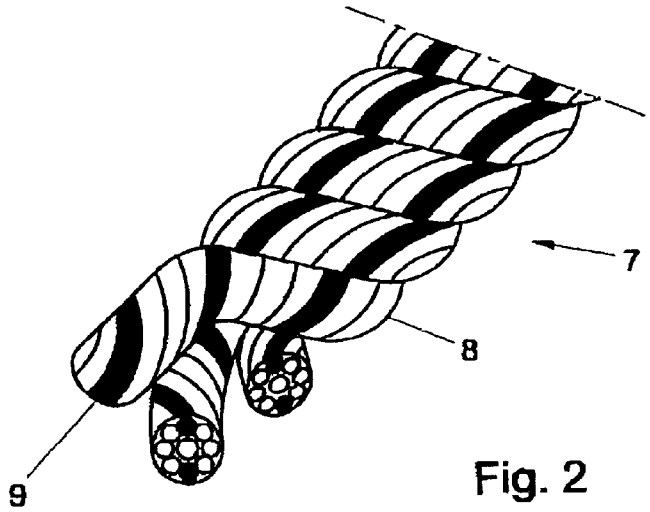
FIG. 2 shows a somewhat schematized perspective representation of an electric wire or rope.

The fence tape 1 according to FIG. 1 is designed as plaiting with an electrically substantially non-conductive support structure which is formed by filaments 2 of, for instance, PE monofilaments of 0.2–0.5 mm. These are represented in contour in the drawing.

The fence tape further has an electrically conductive conduction structure, exposed to the environment, which in this example is formed by conductive filaments 3. These filaments 3 are represented in solid black in the drawing.

The textile construction of the tape 1 according to this example is conventional, with conductors 3 which per unit length of the tape 1 have a greater length than the electrically non-conductive filaments 2, so that the former lie fairly loosely within the textile structure from non-conductive material and any tensile loading exerted on the tape 1 is exerted substantially on the textile structure from non-conductive material.

The filaments 3 of the conduction structure are composed of two different, electrically conductive materials 4, 5 (see FIG. 3), having mutually distinctive electrical and mechanical properties. One of these materials 4 has a better electrical conductivity than the other one of these materials 5. The other one of these materials 5 has a better resistance to tensile and bending loads than the first of these materials 4. The electrically better conductive material is preferably copper, but could also be another electrically well-conducting material, such as aluminum. The other electrically well-conducting material is preferably corrosion-resistant steel (RVS, stainless steel), for instance corrosion-resistant steel Euronorm 88-71 type X6CrNi18 10, X6CrNiTi18 10, X6CrNiMO17 12 2 or X6CrNiMOTi17 12 2 (AISI type 304, 321, 316 or 316 Ti), since corrosion-resistant steel combines good mechanical properties with a very good resistance to corrosion. It is also possible, however, to use a jacket from a different material, such as steel, but in that case, a surface treatment, such as electroplating, is necessary to achieve a corrosion-resistance that is acceptable in practice.

The electrically better conducting material, viewed in cross section, forms a conduction zone 4 and the other material, better in terms of tensile and bending loadability, constitutes a self-supporting support zone 5.

Through the presence of the conduction zone 4 from electrically highly conductive material, the total conductivity of the filament 3 is very good.

Although the mechanical loading in the form of chiefly tensile loading is substantially taken up by the textile support structure from electrically non-conductive material, the electrically conductive filaments 3, which are incorporated in a longitudinally slack, i.e., not taut, fashion in the textile construction, and may optionally project therefrom as flat loops, are also subject to mechanical loading. This is for instance the case if the tape 1 is knotted or clamped, and, in the area of the points of attachment, this last especially under the influence of wind, moves back and forth relative to the point of attachment, or actually flaps.

The support zone 5 constitutes a stiffening of the filament and takes up an important part of the mechanical loads exerted on the filament 3. As a result, the electrically better conducting material in the conduction zone 4 is loaded to a lesser extent and rupture of the conduction zone is prevented.

Especially if the material in the support zone 5 has a higher modulus of elasticity than the material in the conduction zone 4, a considerable relief of the material in the conduction zone can already be achieved with relatively little material in the support zone 5. This is the case, for instance, if the material of the support zone 5 is corrosion-resistant steel (modulus of elasticity $200\times10^9$ Pa) and the material in the conduction zone 4 is copper (modulus of elasticity $124\times10^9$ Pa). The support zone 5 preferably covers at least 5% but preferably not more than 20% of the area of the cross section of the filament 3.

Figure 6:
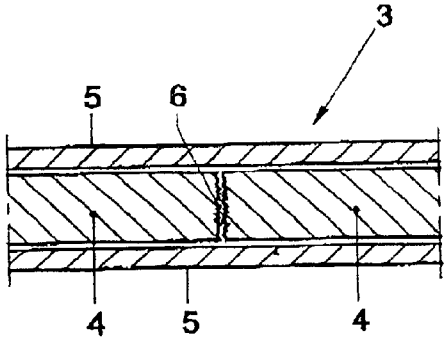
FIG. 6 shows an elevation in longitudinal section of an example of partial rupture behavior of a filament according to an exemplary embodiment.

If the material in the conduction zone ruptures nonetheless, and an interruption 6 is formed in the conduction zone 4, the support zone 5—as is represented by way of example in FIG. 6—constitutes a bridging of the interruption 6 of the conduction zone 4, so that the electrical conductivity of the filament 3 is not interrupted. Although the electrical conductivity of the support zone 5 can be substantially poorer than the electrical conductivity of the conduction zone 4 (the specific resistance of corrosion-resistant steel, for instance, is about 30–40 times as high as the specific resistance of copper), the total electrical conductivity of a filament 3 in such a case decreases only very little. In fact, as the support zone 5 and the conduction zone 4 from different materials are part of the same filament 3, the distance over which the support zone 5 bridges the conduction zone 4 electrically is very short, so that the higher resistance sustained by the current in the support zone 5 has relatively little influence on the total resistance over a greater length.

Figure 3:
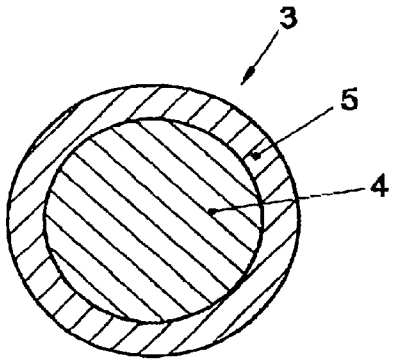
FIGS. 3–5 show enlarged views in cross section of filaments according to three exemplary embodiments.

In the filament 3 according to FIG. 3, the conduction zone 4 constitutes a core of the filament 3, and the support zone 5 constitutes a jacket of the filament 3, which envelops the core 4. This provides the advantage that the support zone 5 constitutes a particularly effective contribution to the take-up of bending loads exerted on the filament 3, in that the support zone 5 is located in the area of the filament 3 where bending gives rise to the greatest deformations and where the contribution to the resistance moment against bending is greatest. Also as a result of these effects, a great improvement of the life of the filaments can already be achieved with a very small proportion of material having the better mechanical properties (for instance about 5–20% and preferably about 10%). A small proportion of material having the better mechanical properties is advantageous, because as a consequence, a largest possible proportion of material having the better conductivity is available for the main function of the electrically conductive filaments, viz. the conduction of electricity.

Further, the conduction zone 4 is situated in the area of the filament 3 which deforms least in the event of bending, so that the mechanical loading thereof is comparatively limited.

In case of interruption of the conduction zone 4, the jacket-shaped support zone 5 keeps the ends of the conduction zone 4 bounding the interruption 6 very close together, in that these ends are confined within the jacket 5.

That the jacket-shaped support zone 5 envelops the conduction zone 4 further prevents exposure of the interface between the two zones 4, 5 to ambient influences which cause electrolytic corrosion there.

A further advantage of the use of a jacket-shaped support zone 5 which envelops the conduction zone 4 is that the integrity of the composite conductor is not dependent on adhesion between the two zones 4, 5. To simplify the manufacture of the filament, use is made of this advantage, by providing that the conduction zone 4 is in adhesion-free contact with the support zone 5. The necessity for a special processing operation such as welding or rolling for bonding the zones 4, 5 together can thus be dispensed with. A further advantage of the absence of adhesion between the conduction zone 4 and the support zone 5 is that in case of tearing of the conduction zone 4, continuation of the tear into the support zone 5 or vice versa is prevented.

According to the present example, the material of the support zone 5 is corrosion-resistant steel, so that the jacket-shaped support zone 5 is moreover highly effective for screening the conduction zone 4 from the surroundings, thereby preventing corrosion of the conduction zone 4 and damage of the conduction zone by chafing.

In the filament 3 according to this example, as material for the conduction zone, substantially copper is used, which yields a very good electrical conductivity.

For the use of the filament 3 in electrifiable fence tape, rope or wire, the diameter of the electrically conductive filaments 3 is preferably 0.05 mm to 1 mm, a diameter of 0.2 to 0.4 mm being presently preferred most. Such filaments 3 can be manufactured in a manner known per se by rolling a strip of material around a core and sealing the strip along a seam in longitudinal direction.

It will be clear to those skilled in the art that within the framework of the present invention, many other variants are possible. Thus, as represented in FIG. 4, a filament 10 can be designed, for instance, as a sandwich construction, with a core 11 from material having better electrical conductivity disposed between two layers 12 from material having better mechanical properties.

Figure 5:
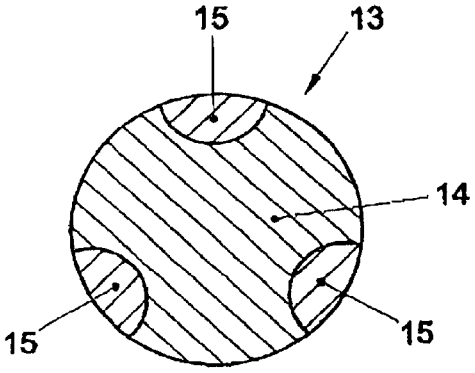

FIG. 5 shows a further alternative exemplary embodiment of a filament 13, in which, viewed in cross section, in a central conduction zone 14 from a first material, support zones 15 from a second material having less good electrical conductivity but having better mechanical properties than the first material have been rolled-in.

Figure 4:
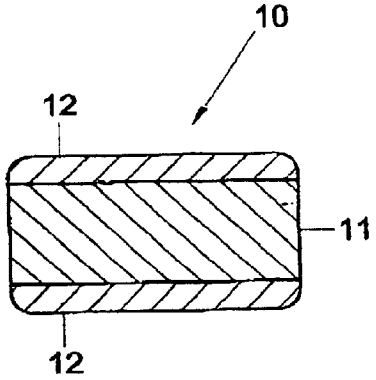

Also in the examples according to FIGS. 4 and 5, the conduction zone is situated in a central position, and the support zones are in peripheral positions with respect to the conduction zone, so that the support zones 12, 15 are particularly effective for limiting mechanical loads of the conduction zone 11, 14 and for keeping the ends of the conduction zone resulting from interruption of the conduction zone at a very short mutual distance. Further, the filaments 10, 13 according to FIGS. 4 and 5 each contain several support zones 12, 15. This provides the advantage that in case of rupture of one of the support zones 12, 15, there is still a further support zone present which prevents complete interruption of the filament. Further, the support zones 12, 15, because a plurality of them are present, each separately have a lesser thickness, so that without great elongation and upsetting they can follow bending movements of the filaments 10, 13 with a small radius.

What is claimed is:

1. A fence tape, rope or wire for transmitting an electric current to animal that touches the fence tape, rope or wire, comprising an electrically substantially non-conductive support structure and an electrically conductive conduction structure at least locally exposed electrically to the environment, having at least two different, electrically conductive materials having mutually distinctive electrical and mechanical properties, a first one of the materials having a better electrical conductivity than the second one of the materials, and the second one of the materials having a greater resistance to tensile and bending loads than the first one of the materials, the conduction structure comprising at least one composite filament, having, viewed in cross section, a conduction zone from the first, electrically better conducting one of the materials, and a self-supporting support zone from the second one of the materials, being the stronger material as to tensile and bending loadability, wherein the conduction zone constitutes a core of the at least one filament, and wherein the support zone constitutes a jacket of the at least one filament, which envelops the core, wherein the conduction zone is in adhesion-free contact with the support zone.

2. A fence tape, rope or wire according to claim 1, wherein the material of the support zone is corrosion-resistant steel.

3. A fence tape, rope or wire according to claim 1, wherein the material of the conduction zone is substantially copper.

4. A fence tape, rope or wire according to claim 3, wherein the at least one filament has a cross-sectional area of which at least 5% forms part of the support zone.

5. A fence tape, rope or wire according to claim 1, wherein the at least one filament has a cross-sectional area of which at least 5% forms part of the support zone.

6. A fence tape, rope or wire for transmitting an electric current to an animal that touches the fence tape, rope or wire, comprising:

an electrically substantially non-conductive support structure, and an electrically conductive conduction structure at least locally exposed electrically to the environment, having at least two different, electrically conductive materials having mutually distinctive electrical and mechanical properties, a first one of the materials having a better electrical conductivity than the second one of the materials, and the second one of the materials having a greater resistance to tensile and bending loads than the first one of the materials, the conduction structure comprising at least one composite filament having, viewed in cross section, a conduction zone from the first, electrically better conducting one of the materials, and a self-supporting support zone from the second one of the materials, being the stronger material as to tensile and bending loadability, wherein the support zone constitutes a core of the at least one filament, and wherein the support zone constitutes a jacket of the at least one filament, which envelops the core, wherein the at least one filament has a cross-sectional area of which at least 5% and less than 20% forms part of the support zone.

7. An electrically conductive filament for a fence tape, rope or wire having a diameter between 0.05 mm and 1 mm, having a composite structure having at least two different, electrically conductive materials having mutually distinctive electrical and mechanical properties, a first one of the materials having a better electrical conductivity than the second one of the materials, and the second one of said materials having a greater resistance to tensile and bending loads, while, viewed in cross section, a conduction zone is manufactured from the first, electrically better conductive one of the materials, and a self-supporting support zone is manufactured from the second one of the materials, being the stronger material as to tensile and bending loadability, wherein the conduction zone forms a core and wherein the support zone forms a jacket which envelops the core, wherein the conduction zone is in adhesion-free contact with the support zone.

8. A filament according to claim 7, wherein the material of the support zone is corrosion-resistance steel.

9. A filament according to claim 7, wherein the material of the conduction zone is substantially copper.

10. A filament according to claim 9, having a cross-sectional area of which at least 5% forms part of the support zone.

11. An electrically conductive filament for a fence tape, rope or wire having a diameter between 0.05 mm and 1 mm, having a composite structure having at least two different electrically conductive materials having mutually distinctive electrical and mechanical properties, a first one of the materials having a better electrical conductivity than the second one of the materials, and the second one of said materials having a greater resistance to tensile and bending loads, while, viewed in cross section, a conduction zone is manufactured from the first, electrically better conductive one of the materials, and a self-supporting support zone is manufactured from the second one of the materials, being the stronger material as to tensile and bending loadability, wherein the conduction zone forms a core and wherein the support zone forms a jacket which envelope the core, and wherein the filament has a cross-sectional area of which at least 5% and less than 20% forms part of the support zone.

* * * * *

UNITED STATES PATENT AND TRADEMARK OFFICE

CERTIFICATE OF CORRECTION

PATENT NO. : 6,710,253 B2
DATED : March 23, 2004
INVENTOR(S) : Dirk Wildschut

It is certified that error appears in the above-identified patent and that said Letters Patent is hereby corrected as shown below:

Title page,
Item [57], ABSTRACT,
Line 4, please delete "(3)" and "(3)".
Line 9, please delete "(3)".
Line 10, please delete "(4)".
Line 12, please delete "(5)".
Line 17, please delete "(3)".

Column 6,
Line 24, please delete "to animal" and insert therefor -- to an animal --

Column 7,
Line 11, please delete "support" and insert therefor -- conduction --

Column 8,
Line 4, please delete "resistance" and insert therefor -- resistant --

Signed and Sealed this

Sixteenth Day of November, 2004

JON W. DUDAS
*Director of the United States Patent and Trademark Office*